US005117402A

United States Patent [19]

Myers et al.

[11] Patent Number: 5,117,402

[45] Date of Patent: May 26, 1992

[54] SUPPORT STAND FOR MARINE VIBRATOR

[75] Inventors: Wilbur J. Myers, Ft. Worth; Michael E. Sanders, Ponca City, both of Tex.

[73] Assignee: Conoco Inc., Ponca City, Okla.

[21] Appl. No.: 300,195

[22] Filed: Jan. 23, 1989

Related U.S. Application Data

[62] Division of Ser. No. 168,202, Mar. 15, 1988, abandoned.

[51] Int. Cl.[5] ..... H04R 23/00

[52] U.S. Cl. ..... 367/143; 367/173; 248/676

[58] Field of Search ..... 248/676, 671, 680, 681, 248/154, 153, 310, 313, 316.7, 311.3, 127, 146; 367/173, 189, 143; 181/114; 114/270, 343, 364

[56] References Cited

U.S. PATENT DOCUMENTS

| | | | |
|---|---|---|---|
| 198,905 | 1/1878 | Sechler . | |
| 279,238 | 6/1883 | Geiger . | |
| 740,264 | 9/1903 | Fitzgerald | 248/146 |
| 967,368 | 8/1910 | Grigsby | 248/153 X |
| 1,771,581 | 7/1930 | Moon . | |
| 2,182,709 | 12/1939 | Sissom | 248/146 |
| 2,199,481 | 5/1940 | Chappell | 248/146 |
| 2,641,382 | 6/1953 | Mason | 220/69 |
| 2,657,891 | 11/1953 | Haften et al. | 248/146 |
| 2,743,893 | 5/1956 | Johnston et al. | 248/DIG. 1 |
| 2,766,622 | 10/1956 | Johnson | 367/173 X |
| 2,780,196 | 2/1957 | Jareckie | 367/173 X |
| 2,955,828 | 10/1960 | Kinsella | 248/154 X |
| 3,043,465 | 7/1962 | Horner | 248/310 X |
| 3,226,075 | 12/1965 | Hopkins et al. | 248/146 X |
| 3,494,443 | 2/1967 | Huffhines | 181/5 |
| 3,595,508 | 7/1971 | Knight | 248/146 |
| 3,810,524 | 5/1974 | Dransfield | 181/114 X |
| 3,841,269 | 10/1974 | Urruela | 114/74 |
| 4,078,632 | 3/1978 | Horsman | 181/114 X |
| 4,344,645 | 8/1982 | Kirk | 285/61 |
| 4,660,675 | 4/1987 | Airhart | 181/114 X |
| 4,692,906 | 9/1987 | Neeley | 367/173 X |
| 4,853,905 | 8/1989 | Myers | 367/143 |
| 4,881,210 | 11/1989 | Myers et al. | 367/173 |
| 4,892,051 | 1/1990 | Taylor et al. | 114/270 X |

*Primary Examiner*—Karen J. Chotkowski

[57] ABSTRACT

A shipboard support stand for a marine vibrator of the type having characteristic revolutional shape about the vertical axis and a lower concentric guide ring surface which consists of a support ring of circumfery generally equal to the circumference of the vibrator supported by plural vertical supports above the ship's deck, and which further includes a reduced diameter locating ring secured concentrically and at lower elevation from the support ring such that the vibrator can be supported on the support ring with the vibrator guide ring closely retained within the locating ring to stow the vibrator securely.

10 Claims, 3 Drawing Sheets

SUPPORT STAND FOR MARINE VIBRATOR

This is a divisional of application Ser. No. 168,202, filed on Mar. 15, 1988, now abandoned.

BACKGROUND OF THE INVENTION

1. Field of the Invention

The invention relates generally to marine vibator support hardware and, more particularly, but not by way of limitation, it relates to an improved vibrator stand for ship's deck installation that enables secure capture and locking retention of a marine vibrator on-board the ship.

2. Description of the Prior Art

There have been various approaches to the handling and stowage of marine seismic vibrator equipment on or about the tow vessel during and between seismic sounding operations. There have been a number of different drag devices such as submerged stiff leg wherein the vibrator device is not hauled clear of the water during operations and only stowed on-board the tow vessel after completion of the survey operation. Still other prior teachings practice boom suspension of the seismic source. U.S. Pat. No. 3,494,443 provides an example of the boom suspension type of device but this design is primarily dictated by the type of seismic source, i.e., a pneumatic exploder device. U.S. Pat. No. 3,841,269 provides a teaching of somewhat more general nature wherein a support device is constructed for bearing solid of revolution (rounded) tanks having vertical axes of revolution for stowage on-board ships. U.S. Pat. No. 3,595,508 teaches a tank support assembly for use on-board aircraft; and, U.S. Pat. No. 4,344,645 teaches a tri-legged bracket member for supporting a particular form of tank having a hemispherical-type bottom surface. The design of this bracket support is influenced primarily by the need for pipe connection access on or around the lower portions of the tank.

SUMMARY OF THE INVENTION

The present invention relates to an improved type of shipboard support assembly for a marine seismic transducer, particularly a seismic vibrator of the type having a generally spherical bottom surface with a concentric guide ring extending therebelow. The support stand includes an outer support ring having a dish-type conical surface secured therein and defining a lowermost locating ring for receiving the vibrator guide ring in secure engagement. Thus, despite rolling and/or pitching of the tow vessel, the lowered seismic transducer can be easily captured and retained in the support stand.

Therefore, it is an object of the present invention to provide a relatively simple yet highly effective seismic transducer support stand for ship's deck usage.

It is also an object of the present invention to provide a seismic transducer support stand and locking device for permanently securing the seismic transducer for extended surface travel and/or heavy seas.

It is yet another object of the present invention to provide a support stand that readily receives a seismic transducer during repeated on-board attitudes during a survey operation.

Finally, it is an object of the present invention to provide a seismic vibrator support stand that is sturdy, readily accessible and occupies minimum deck space on-board a tow vessel.

Other objects and advantages of the invention will be evident from the following detailed description when read in conjunction with the accompanying drawings which illustrate the invention.

DETAILED DESCRIPTION OF THE INVENTION

Figure 1:
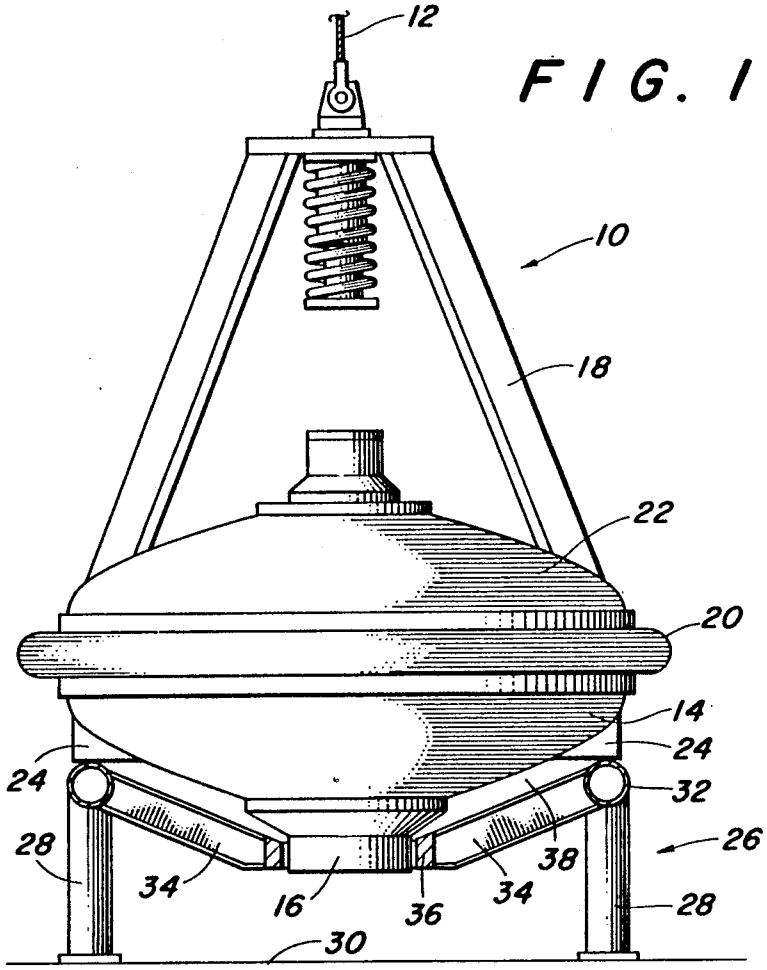
FIG. 1 is a view in elevation of a seismic vibrator as retained in support stand of the present invention.

Referring to FIG. 1, a seismic transducer 10 supported by a lift cable 12 includes a spherical bottom plate 14 with a bottom most concentric guide ring 16. The transducer 10 is a standard type of marine hydraulic vibrator consisting of a tripod 18 and vibrator assembly 20 having lower spherical plate 14 and upper plate 22. A plurality of support lugs 24, e.g., four support lugs 24, are provided in equal spacing around the periphery of lower plate 14 for the purpose of contacting and locking with a shipboard support stand 26.

The shipboard support stand 26 includes a plurality of vertical support legs 28 each firmly secured, as by welding, to the ship's deck 30. An uppermost support ring 32 is secured on top of the support legs 28 and a plurality of radial channels 34 are secured to extend inward and downward from support ring 32 into affixure with a concentric locating ring 36. A conical plate 38, an inverted truncated cone, is then affixed concentric with support ring 32 and secured on radial channels 34.

Figure 3:
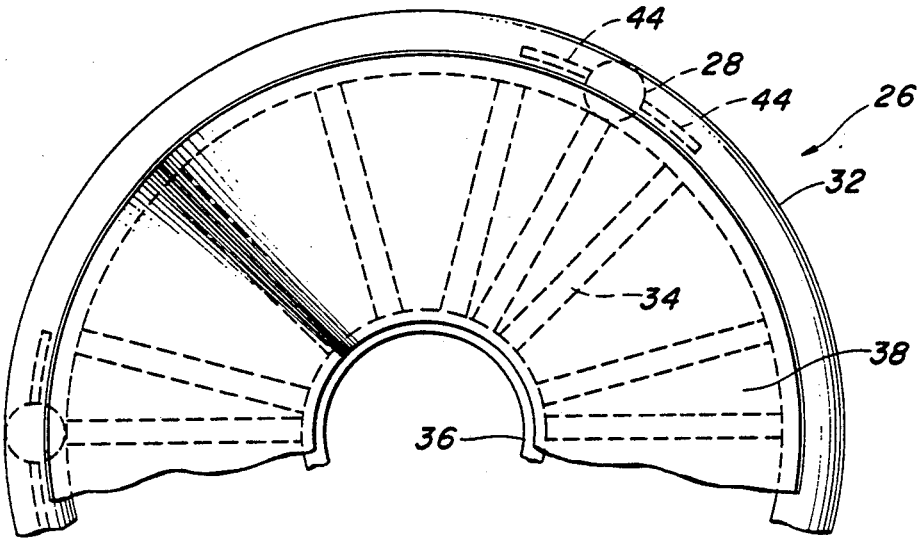
FIG. 3 is a top plan view of the section view portion of FIG. 2
Figure 2:
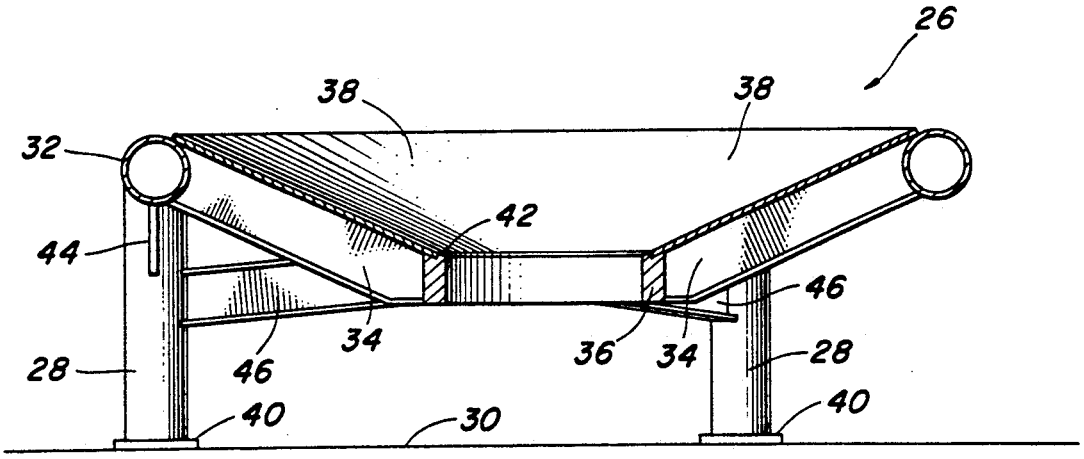
FIG. 2 is a vertical cross section of the support stand.

FIGS. 2 and 3 illustrate the construction of support stand 26 in greater detail. A preferred construction specifies the use of low carbon steel for all parts. The support ring 32 may be formed from extra strong steel pipe on the order of 3.5 inches outside diameter and the support ring 32 is supported as by weld affixure on a triad or quadrature array of vertical legs 28 which may be formed of the similar steel pipe. The vertical legs 28 are then weld secured through one-half inch steel foot plates 40 to the ship's deck 30. A plurality of radially aligned struts 34 are secured as by welding to the inner sides of support ring 32 to extend downward at a selected angle into weld affixure with the inner locating ring 36. In current design the struts 34 are formed from No. 4.1 American Standard Channel (3 inch$\times$1½ inch) and each is disposed at an angle of 23° to the horizontal as affixed to locating ring 36. A seating notch 42 upstanding on locating ring 36 (FIG. 2) provides a surface for centering a conical plate 38, as will be further described. The strut and seating notch angles are not critical but need only allow relative sliding as between vibrator guide ring 16 and conical plate 38 during seating.

A plurality of generally equally spaced struts 34 are utilized, on the order of 15 struts spaced from 15° to 30° apart. Struts 34 adjacent a strut connecting directly to a support leg 28 are placed closer than intermediate struts to provide the requisite strength (see FIG. 3). A plurality of triangular gussets 44 are connected in the joinder between leg supports 28 and support ring 32 to provide lateral reinforcement. Additional lower strut channels 46 are welded between each support leg 28 and the locating ring 36. The conical plate 38 of one-quarter inch plate steel is then welded within the confines of support ring 32 and locating ring 36.

Figure 4:
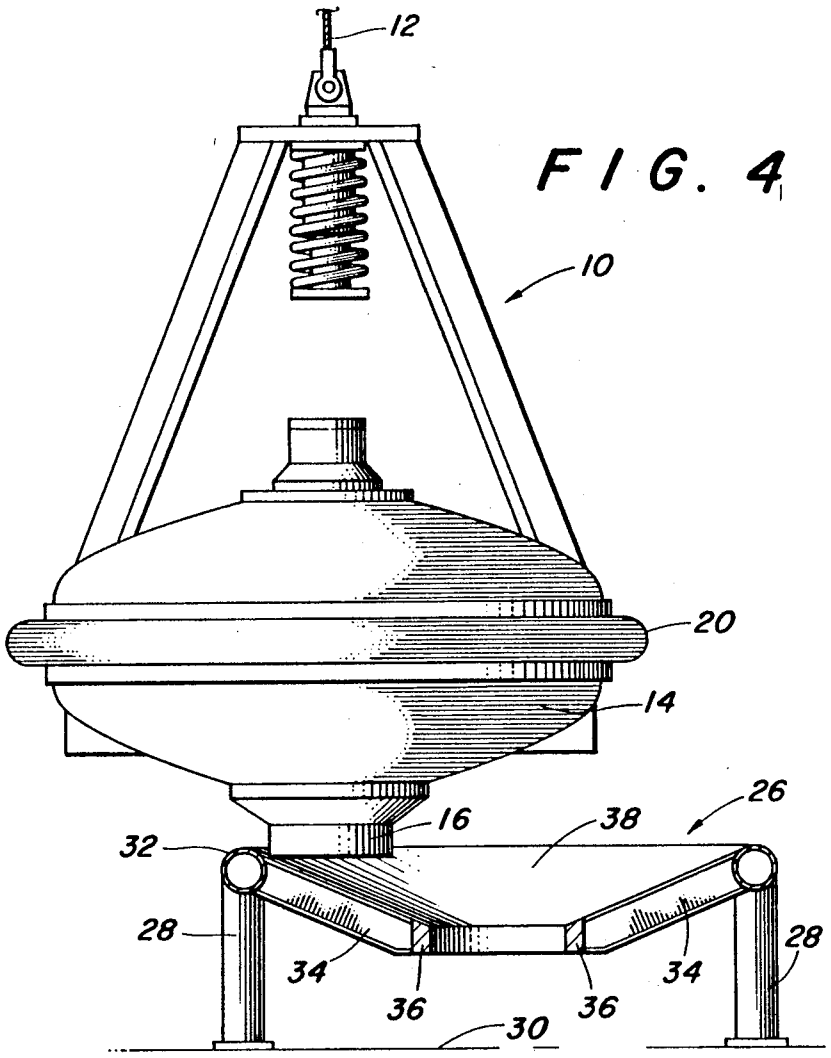
FIG. 4 is an operational view in elevation of a seismic vibrator during capture and retention within the support stand.

FIG. 4 illustrates the apparatus in operation as the seismic transducer 10 is swung into contact with one edge of conical plate 38 of support stand 26 whereupon it is steadied for further sliding downward with guide ring 16 coming within locating ring 36 and the support lugs 24 resting firmly on support ring 32. When in operation aboard a moving tow vessel, the seismic transducer must be deployed in the water and retracted many times. Due to the rocking action of the boat, it has been found to be very difficult to control or properly retain the seismic transducer on board the vessel. The support stand 26 provides apparatus that both captures and steadies the swinging transducer 10 for subsequent easing into the full seated and secured position.

Figure 5:
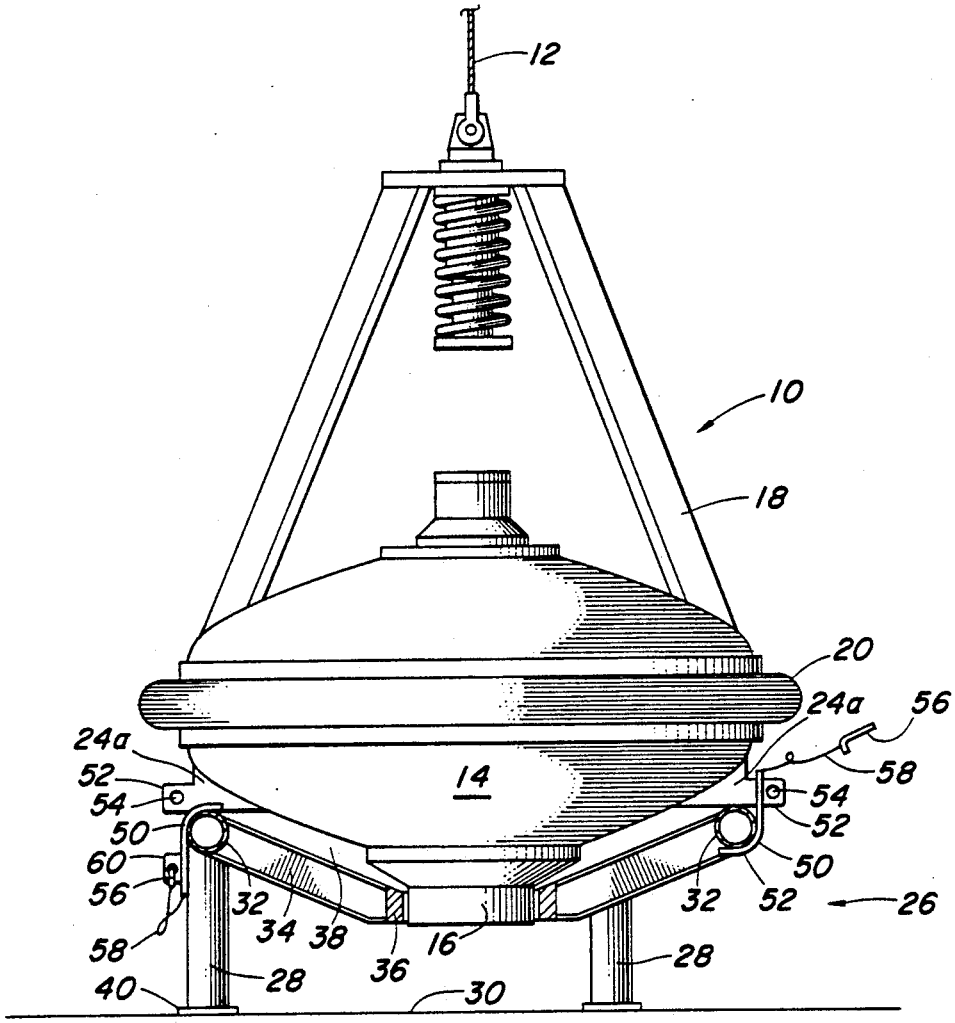
FIG. 5 is a view in side elevation of the seismic transducer and support stand with locking device.
Figure 6:
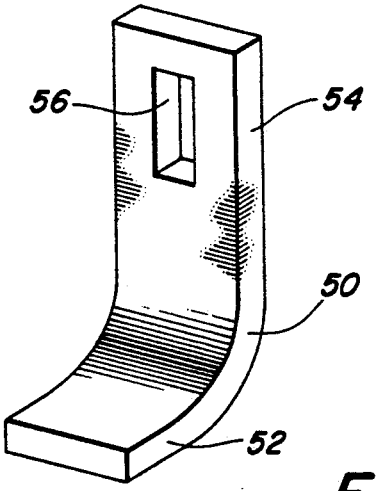
FIG. 6 is a perspective view of a locking bracket as constructed in accordance with the present invention.

When the seismic transducer 10 is centrally seated within support stand 26, it is desirable to have a means for securing transducer 10 to support stand 26 that is simple, quick and easy to operate. FIGS. 5 and 6 illustrate such a locking device in the form of a J-bracket 50 which is formed as a right angularly curved lower portion 52 and a straight shank portion 54 having a locking slot 56 formed therethrough. In this case, each of the support lugs 24*a* is further formed to extend a lateral locking tab 52 having a hole 54 for receiving a locking pin 56. The locking pin 56 is suitably retained by a suitable tether cable 58 connected to J-bracket 50. A standard plunger-operated ball lock pin may be utilized as the locking pin 56 and utilization of two or more J-brackets 50 are required in order to best secure seismic transducer 10 in the support stand 26.

Shown on the left side of FIG. 5 is a J-bracket 50 shown in the stowed position. Then when deploying the transducer, the ball lock pin 56 is removed to release the hold-down bracket which, in turn, is turned upside down and placed over a lug tab 60 welded on the support leg 28 whereupon the lock pin 56 is reinserted. This arrangement provides a convenient means for storing the J-brackets 50 and pins 56 when not in use, i.e., when the seismic transducer has been deployed in the water.

The foregoing discloses a novel form of support stand for guiding and retention of a seismic transducer on-board a tow vessel. The device provides optimum handling capability for stowage of a marine seismic transducer on-board the deck of the tow vessel. When the transducer is properly positioned within the support stand, all weight of the transducer is supported by the support ring as securely positioned on the ship's deck. It should be understood that while certain structural diameter dimensions, angular slopes and the like are specified herein, these are variable as a design choice to accommodate various other bottom contours and shapes while still enabling a support receptacle that is capable of easy capture and final retention of the transducer in locked position.

Changes may be made in combination and arrangement of elements as heretofore set forth in the specification and shown in the drawings; it being understood that changes may be made in the embodiments disclosed without departing from the spirit and scope of the invention as defined in the following claims.

The embodiments of the invention in which an exclusive property or privilege is claimed are as follows:

1. Shipboard securing apparatus for positioning and securing a cable-supported marine vibrator of the type having a generally spherical lower section, the combination comprising:

a seismic transducer which includes a vibrator assembly having a generally spherical bottom plate that is symmetrical about a vertical axis and defined by an outer circumfery;

a lower guide ring secured to the bottom plate concentrically about said vertical axis to extend below said bottom plate;

plural spaced support lugs secured around the outer circumfery of the bottom plate and defining a selected circumference;

a support ring having a circumference that is approximately the same as the circumference of said support lugs;

vertical stand means secured on a deck surface and supporting said supporting ring on shipboard in generally horizontal attitude;

a locating ring having a diameter to receive therethrough said vibrator lower guide ring; and means supporting said locating ring concentric to and parallel beneath said support ring.

2. Apparatus as set forth in claim 1 which further includes:

securing means for locking at least one of said vibrator support lugs to said support ring.

3. Apparatus as set forth in claim 1 which further includes:

a conical plate secured between said support ring and said locating ring.

4. Apparatus as set forth in claim 1 wherein said means supporting comprises:

plural radially aligned struts secured between said support ring and said locating ring; and a conical plate secured in overlay of said struts and extending from said support ring to said locating ring.

5. Apparatus as set forth in claim 4 which further includes:

securing means for locking at least one of said vibrator support lugs to said support ring.

6. Apparatus as set forth in claim 2 wherein said securing means comprises:

a J-shaped bracket plate having a round portion for affixure around said supporting ring and extending a straight portion with locking slot into engagement with a vibrator support lug; and pin means receivable through said vibrator support lug in capture of said bracket plate straight portion.

7. Apparatus as set forth in claim 4 which further includes:

a J-shaped bracket plate having a round portion for affixure around said supporting ring and extending a straight portion with locking slot into engagement with a vibrator support lug; and pin means receivable through said vibrator support lug in capture of said bracket plate straight portion.

8. Apparatus as set forth in claim 1 wherein said vertical stand means comprises:

plural vertical pipe members secured in generally equal spacing between the support ring and the shipboard position.

9. Apparatus as set forth in claim 8 which further includes:

plural radial struts secured generally horizontally between each vertical pipe member and said locating ring.

10. Apparatus as set forth in claim 3 wherein:

said conical plate is the sector of a cone having base to height ratio of approximately four to one.

* * * * *